US008592734B2

(12) United States Patent
Kwag et al.

(10) Patent No.: US 8,592,734 B2
(45) Date of Patent: Nov. 26, 2013

(54) HEATER HOLDER AND ELECTRIC HOB INCLUDING THE SAME

(75) Inventors: Dong Seong Kwag, Seoul (KR); Byeong Wook Park, Seoul (KR); Yang Kyeong Kim, Seoul (KR); Young Jun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 834 days.

(21) Appl. No.: 12/404,813

(22) Filed: Mar. 16, 2009

(65) Prior Publication Data

US 2009/0230122 A1 Sep. 17, 2009

(30) Foreign Application Priority Data

Mar. 17, 2008 (KR) ..... 10-2008-0024233

(51) Int. Cl.
*H05B 6/12* (2006.01)

(52) U.S. Cl.
USPC ..... 219/622; 219/461

(58) Field of Classification Search
USPC ..... 219/258, 259, 254, 242, 226, 209, 213, 219/217, 622, 542, 601, 538, 553, 461, 459, 219/444, 456, 458, 463, 467, 451, 457, 219/464; 99/281, 288, 339, 331, 325, 340, 99/349, 378, 389, 422, 451, 447, 449, 400, 99/401
See application file for complete search history.

(56) References Cited

U.S. PATENT DOCUMENTS

| | | | | | |
|---|---|---|---|---|---|
| 5,136,142 | A * | 8/1992 | Logan | ..... | 219/454.11 |
| 5,153,413 | A * | 10/1992 | Wilde | ..... | 219/458.1 |
| 5,415,572 | A * | 5/1995 | Shepherd | ..... | 439/638 |
| 7,385,162 | B2 | 6/2008 | Ryu et al. | | |
| 2002/0136263 | A1 * | 9/2002 | Wilkins | ..... | 374/141 |

FOREIGN PATENT DOCUMENTS

| | | | | |
|---|---|---|---|---|
| JP | 2004138320 | * | 5/2004 | ..... F27B 17/00 |
| KR | 88-11158 | | 7/1988 | |
| KR | 89-16858 | | 8/1988 | |
| KR | 88-23096 | | 12/1988 | |
| KR | 10-2005-0043527 | | 5/2005 | |

OTHER PUBLICATIONS

International Search Report dated Oct. 22, 2009.

* cited by examiner

*Primary Examiner* — Henry Yuen
*Assistant Examiner* — Phuong Nguyen
(74) *Attorney, Agent, or Firm* — KED & Associates LLP

(57) ABSTRACT

Provided are a heater holder and an electric hob including the heater holder. Both end portions of a tube heater are supported by the heater holder having predetermined elasticity. Therefore, food can be cooked more rapidly, and the tube heater can be easily installed. Furthermore, damages caused by heat generated from the tube heater can be minimized.

15 Claims, 8 Drawing Sheets

HEATER HOLDER AND ELECTRIC HOB INCLUDING THE SAME

CROSS-REFERENCE TO RELATED APPLICATIONS

The present application claims priority under 35 U.S.C. 119 and 35 U.S.C. 365 to Korean Patent Application No. 10-2008-0024233 (filed on Mar. 17, 2008), which is hereby incorporated by reference in its entirety.

BACKGROUND

The present disclosure relates to a heater holder for supporting a heater and an electric hob including the heater holder.

Cooking apparatuses are home appliances used to heat and cook foods using electricity or gas. Electric hobs, which have been recently introduced in the market, include a heating source and a plate disposed above the heating source so as to heat a container placed on the plate using the heating source for cooking food contained in the container. A sheath heater, which includes a metal tube and a heating element sealed inside the metal tube, is usually used as the heating source of the electric hob.

However, the above-described electric hobs of the related art have the following disadvantages.

First, the output power of the sheath heater that is used as a heating source is relatively low as compared with other heaters such as a tub heater which generates heat using electric resistance of a filament disposed inside a tube. Therefore, it is difficult to cook food rapidly using the sheath heater.

As explained above, the high-power tube heater includes a tube and a filament disposed inside the tube. However, it is difficult to install the tube heater (substantially, the tube) at a heater base and/or a reflector.

The tube heater can be installed at the heater base and/or the reflector using an additional member. In this case, heat is transferred from the tube heater to the heater base and/or the reflector through the additional member. Therefore, the heater base and/or the reflector can be damaged by heat of the tube heater.

SUMMARY

Embodiments provide a heater holder and an electric hob including the heater holder, which are adapted to cook food rapidly.

Embodiments also provide a heater holder and an electric hob including the heater holder, which are configured to install a heater easily.

Embodiments also provide a heater holder and an electric hob including the heater holder, which are configured to be minimally damaged by heat generated from a heater.

In one embodiment, a heater holder includes: a holder body; a fixing part fixed to one of a heater base at which a tube heater is disposed and a reflector disposed between the tube heater and the heater base; and a heater supporting part extending from the holder body and configured to support the tube heater, wherein the fixing part extends from one of the holder body and the heater supporting part.

In another embodiment, a heater holder includes: a holder body; a fixing part disposed at a side of the holder body, the fixing part being fixed to one of a heater base at which a tube heater is disposed and a reflector disposed between the tube heater and the heater base; and a heater supporting part disposed at a side of the holder body and configured to support the tube heater, wherein the holder body is elastically deformable with respect to the fixing part fixed to one of the heater base and the reflector, and the heater supporting part is elastically deformable with respect to the holder body.

In further another embodiment, an electric hob includes: a heater base; a tube heater disposed at the heater base, the tube heater including a tube and a filament disposed inside the tube; a reflector disposed between the heater base and the tube heater and configured to reflect heat generated from the tube heater; and a heater holder adapted to fix the tube to the heater base or the reflector.

According to the present disclosure, food can be cooked more rapidly, and the tube heater can be easily installed. Furthermore, damages caused by heat generated from the tube heater can be minimized.

The details of one or more embodiments are set forth in the accompanying drawings and the description below. Other features will be apparent from the description and drawings, and from the claims.

DETAILED DESCRIPTION OF THE EMBODIMENTS

An electric hob will now be described according to a first embodiment with reference to the accompanying drawings.

Figure 1:
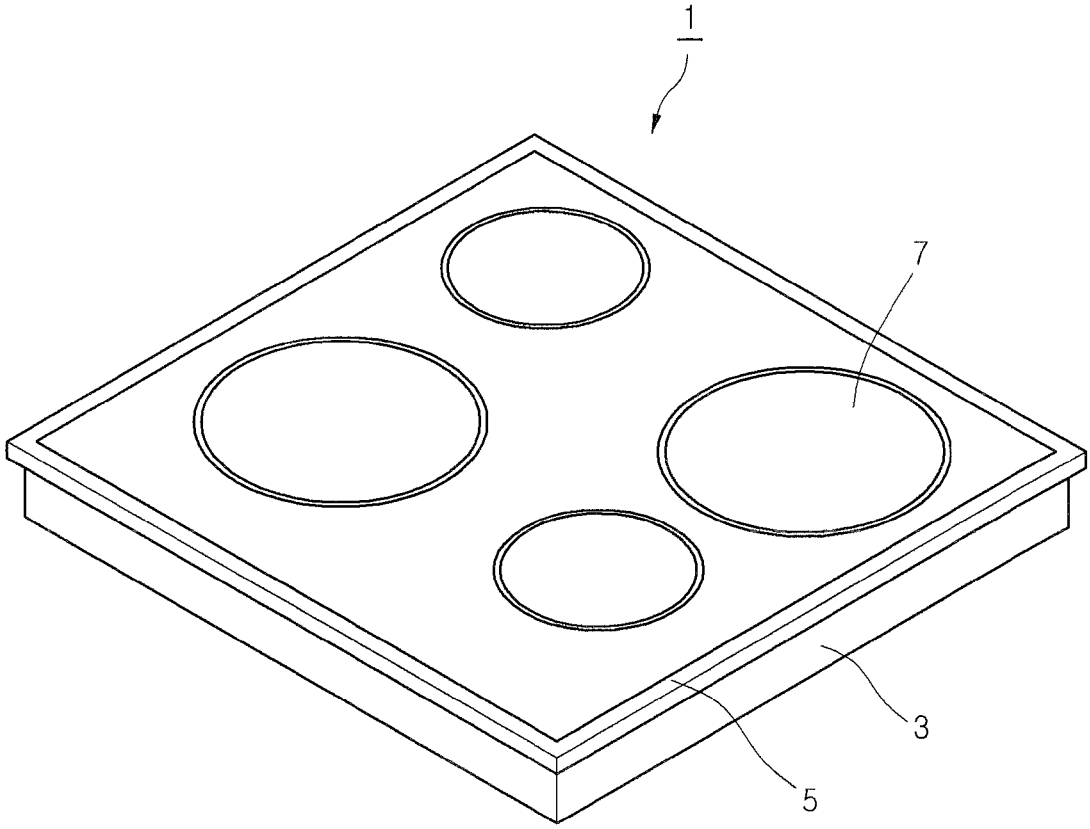
FIG. 1 a perspective view illustrating an electric hob according to a first embodiment.
Figure 2:
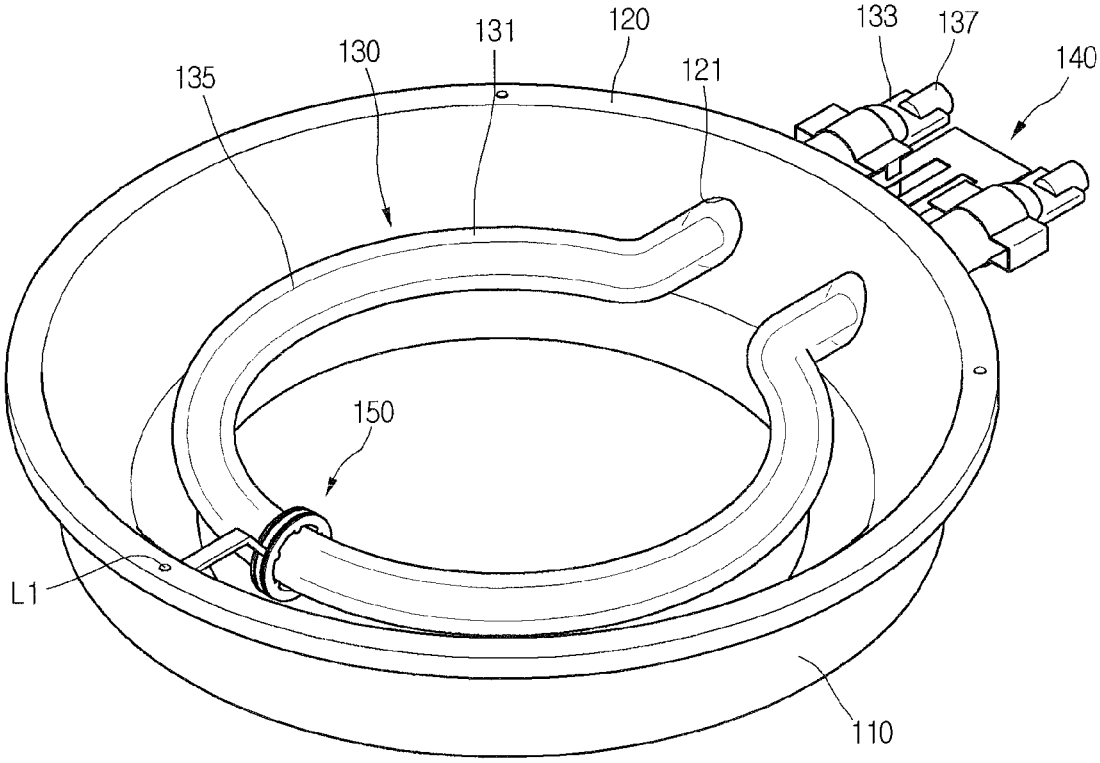
FIG. 2 is a perspective view illustrating a heater assembly according to the first embodiment.
Figure 3:
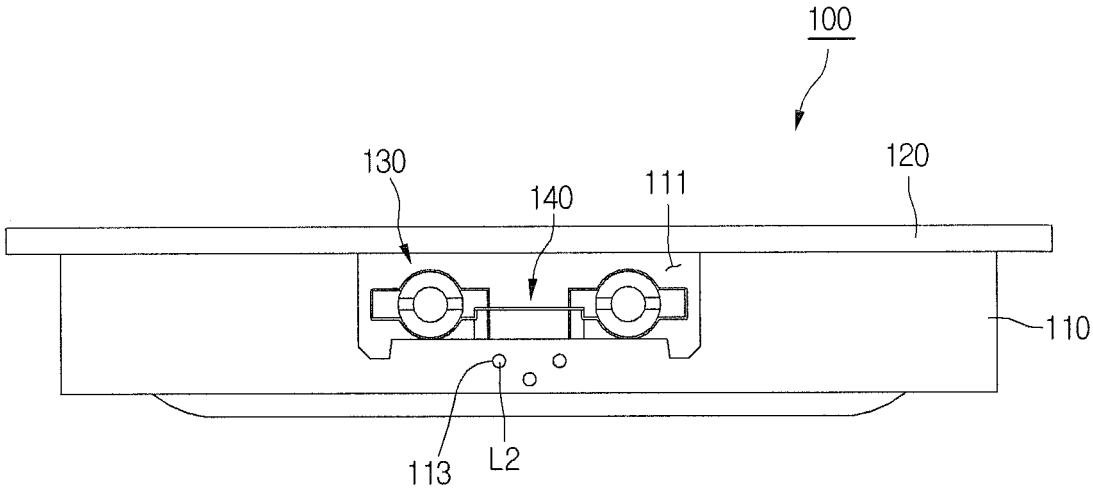
FIG. 3 is a side view illustrating the heater assembly according to the first embodiment.
Figure 4:
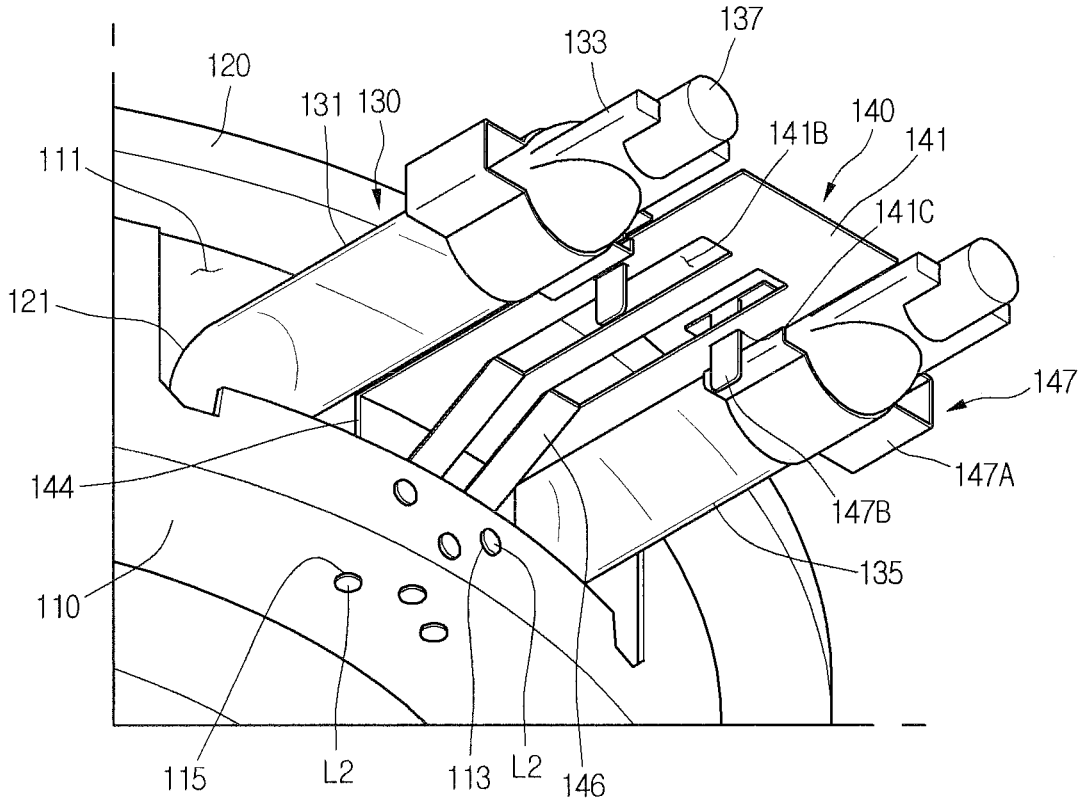
FIG. 4 is a perspective view illustrating a characteristic portion of the heater assembly according to the first embodiment.
Figure 5:
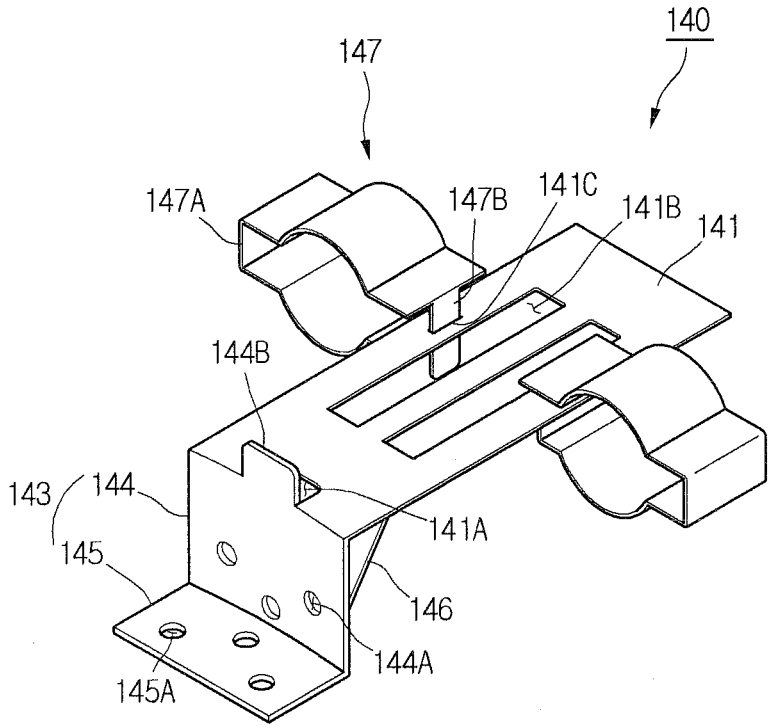
FIG. 5 is a perspective view illustrating a heater holder according to the first embodiment.
Figure 6:
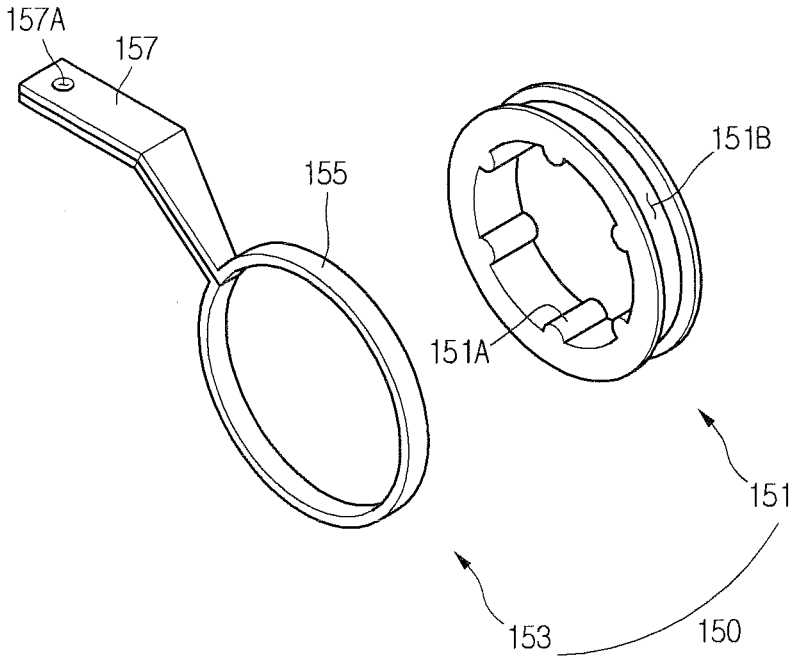
FIG. 6 is an exploded perspective view illustrating a heater supporter according to the first embodiment.
Figure 7:
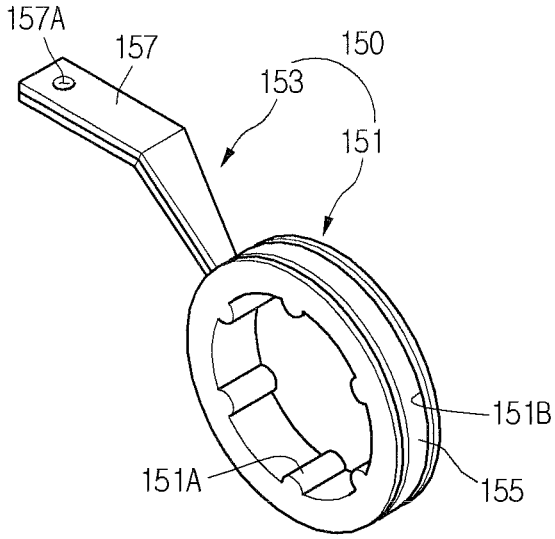
FIG. 7 is a perspective view illustrating the heater supporter according to the first embodiment.

FIG. 1 a perspective view illustrating an electric hob according to a first embodiment; FIG. 2 is a perspective view illustrating a heater assembly according to the first embodiment; FIG. 3 is a side view illustrating the heater assembly according to the first embodiment; FIG. 4 is a perspective view illustrating a characteristic portion of the heater assembly according to the first embodiment; FIG. 5 is a perspective view illustrating a heater holder according to the first embodiment; FIG. 6 is an exploded perspective view illustrating a heater supporter according to the first embodiment; and FIG. 7 is a perspective view illustrating the heater supporter according to the first embodiment.

Referring to FIG. 1, an electric hob 1 includes a casing 3 and a top plate 5. The casing 3 may have an approximately flat hexahedron shape with an opened top. A heating source such as a heater assembly 100 (refer to FIGS. 2 and 3, described later), and other components for operating the electric hob 1 are disposed inside the casing 3. The top plate 5 is disposed on the opened top of the casing 3. A plurality of container seats 7 are marked on the top plate 5 for indicating positions where a container containing food can be placed.

Referring to FIGS. 2 and 3, the heater assembly 100 disposed inside the casing 3 is configured to heat a container placed on the container seat 7 of the top plate 5. The heater assembly 100 includes a heater base 110, a reflector 120, a tube heater 130, a heater holder 140, and a heater supporter 150.

In more detail, the heater base 110 forms a space in which the tube heater 130 is installed. In the current embodiment, the heater base 110 has a flat cylindrical shape with an opened top. A heater penetration opening 111 is formed through a portion of the rim of the heater base 110. Both end portions of the tube heater 130 are inserted through the heater penetration opening 111. The heater penetration opening 111 is formed by cutting a portion of the rim of the heater base 110 into a predetermined shape and size. In addition, a plurality of rim penetration holes 113 and a plurality of bottom penetration holes 115 (refer to FIG. 4) are formed through the rim and bottom of the heater base 110 at a position under the heater penetration opening 111. The rim penetration holes 113 and the bottom penetration holes 115 are used to fix the heater holder 140.

The reflector 120 reflects heat radiated from the tube heater 130. The reflector 120 has a shape corresponding to the shape of the heater base 110, and is disposed inside the heater base 110 in a manner such that the outer surface of the reflector 120 makes contact with the inner surface of the heater base 110. Heater penetration holes 121 are formed through the rim of the reflector 120. Both end portions of the tube heater 130 are inserted through the heater penetration holes 121. The heater penetration holes 121 are formed through a portion of the rim of the reflector 120 at a position aligned with the heater penetration opening 111.

The heater base 110 and the reflector 120 are fixed to each other through first fasteners L1. In the current embodiment, rivets are used as the first fasteners L1; however, the first fasteners L1 for coupling the heater base 110 and the reflector 120 are not limited to the rivets.

The tube heater 130 is installed inside the reflector 120. The tube heater 130 is used to heat food filled in a container. The tube heater 130 includes a tube 131, a filament 135, and two insulating parts 137.

The tube 131 forms the exterior of the tube heater 130. For example, a quartz tube having an approximately horseshoe shape or Q-shape is used as the tube 131. The tube 131 is disposed inside the reflector 120. Both end portions of the tube 131 inserted through the heater penetration holes 121 and the heater penetration opening 111 and extend outward from the reflector 120 and the heater base 110.

Pinch parts 133 are provided on both ends of the tube 131, respectively. The pinch parts 133 are adapted to seal the inside of the tube 131 and fix both ends of the filament 135 and the insulating parts 137. The pinch parts 133 may be formed by compressing both ends of the tube 131 into a flat shape.

The filament 135 is disposed inside the tube 131. Substantially, the filament 135 receives external electricity and generates heat. For this, both ends of the filament 135 are connected to an external power source. For example, the filament 135 may be formed of carbon or a carbon-containing material.

The insulating parts 137 insulate both ends of the filament 135, which are configured to be connected to the external power source. The insulating parts 137 are fixed together with both ends of the filament 135 by the pinch parts 133.

Rods (not shown) may be provided between both ends of the filament 135 and the insulating parts 137 so as to support both ends of the filament 135 elastically. In this case, metal pieces, which are connected to lead wires for receiving external power, may be connected to the rods through the insulating parts 137.

The heater holder 140 is configured to support both ends of the tube heater 130. The heater holder 140 is formed of a material such as metal that has predetermined elasticity for absorbing external impacts and heat resistant properties for resisting heat generated from the tube heater 130. Referring to FIGS. 4 and 5, the heater holder 140 includes holder body 141, a base fixing part 143, reinforcing ribs 146, and heater supporting parts 147.

In more detail, the holder body 141 is shaped like a plate having a predetermined length. When the heater holder 140 is fixed to the heater base 110, the holder body 141 extends outward from the rim of the heater base 110 in a radial direction. The holder body 141 includes a first cutout 141A and second cutouts 141B. The first and second cutouts 141A and 141B are formed as a result of cutting portions of the holder body 141 to form a contact protrusion 144B (described later) and the reinforcing ribs 146. The first cutout 141A is formed by partially cutting an end portion of the holder body 141. The second cutouts 141B are formed by longitudinally cutting a pair of center portions of the holder body 141 which have a predetermined length. The second cutouts 141B are spaced a predetermined distance from each other in a width direction of the holder body 141.

The holder body 141 further includes coupling slots 141C at both side portions. The coupling slots 141C are formed to fix the heater supporting parts 147. The coupling slots 141C are formed by cutting both side portions of the holder body 141, which are located outside the second cutouts 141B, by a predetermined length in a longitudinal direction of the holder body 141.

The base fixing part 143 is formed on an end of the holder body 141. The base fixing part 143 includes a rim fixing part 144 and a bottom fixing part 145. The rim fixing part 144 and the bottom fixing part 145 are formed to fix the heater holder 140 to an inner surface of the heater base 110. In more detail, the rim fixing part 144 is located between the rims of the heater base 110 and the reflector 120. The bottom fixing part 145 is located between the bottoms of the heater base 110 and the reflector 120. The rim fixing part 144 and the bottom fixing part 145 are formed by bending a portion of the holder body 141 from a surface of the holder body 141 or a surface of the rim fixing part 144 to a predetermined angle. In the current embodiment, the rim fixing part 144 is formed by bending a portion of the holder body 141 at a right angle with a surface of the holder body 141, and the bottom fixing part 145 is formed by bending a portion of the rim fixing part 144 at a right angle with the rim fixing part 144. However, the angle between the holder body 141 and the rim fixing part 144, and the angle between the rim fixing part 144 and the bottom fixing part 145 may be varied according to the shapes of the heater base 110 and the reflector 120, specifically, the angles of the rim and bottom of the heater base 110 and the angles of the rim and bottom of the reflector 120.

A plurality of rim coupling holes 144A and a plurality of bottom coupling holes 145A are formed in the rim fixing part 144 and the bottom fixing part 145. Second fasteners L2 are inserted through the rim penetration holes 113 and the bottom penetration holes 115 and are coupled to the rim coupling holes 144A and the bottom coupling holes 145A. Like the first fasteners L1, rivets may be used as the second fasteners L2. However, the second fasteners L2 are not limited to rivets.

The contact protrusion 144B is formed at an end of the rim fixing part 144 opposite to the bottom fixing part 145, that is, at an end of the rim fixing part 144 adjoining the holder body 141. As explained above, the contact protrusion 144B is formed by cutting a portion of the holder body 141 into the shape of the first cutout 141A. The contact protrusion 144B is formed to increase the contact area between the rim fixing part 144 and the rim of the reflector 120. For this, the contact protrusion 144B extends from the holder body 141 in an opposite direction to the rim fixing part 144 but on the same plane as the rim fixing part 144.

The reinforcing ribs 146 reinforce the base fixing part 143, specifically, by supporting the holder body 141 with respect to the rim fixing part 144. That is, the reinforcing ribs 146 reinforce the base fixing part 143 by keeping the holder body 141 at a right angle with the rim fixing part 144. As explained above, the reinforcing ribs 146 are formed by cutting portions of the holder body 141 into the shape of the second cutouts 141B and bending end portions of the cut portions of the holder body 141 around the other end portions of the cut portions so that the end portions of the cut portions can be fixed to a surface of the rim fixing part 144. Therefore, as shown in FIG. 5, the reinforcing ribs 146 make predetermined angles with the holder body 141 and the rim fixing part 144.

The heater supporting parts 147 are disposed at both side portions of the holder body 141, respectively. The heater supporting parts 147 support both end portions of the tube heater 130. In detail, the heater supporting parts 147 support both end portions of the tube 131 which adjoin the pinch parts 133. Each of the heater supporting parts 147 includes a heater receiving part 147A and a coupling rib 147B.

Both end portions of the tube 131 are placed in the heater receiving parts 147A, respectively. For this, the heater receiving parts 147A have a shape corresponding to the shape of both end portions of the tube 131. Substantially, the heater receiving parts 147A extend outward from both side portions of the holder body 141 in a width direction of the holder body 141 and are bent into a shape corresponding to a section of the tube 131 created by a plane cutting the tube 131 perpendicular to a longitudinal direction of the tube 131. Further, the heater receiving parts 147A are arranged at both side portions of the holder body 141 in the width direction of the holder body 141 in alignment with the coupling slots 141C. Furthermore, after the heater receiving parts 147A are bent as described above, leading ends of the heater receiving parts 147A are spaced a predetermined distance from a surface of the holder body 141 in a direction perpendicular to the surface of the holder body 141.

The coupling ribs 147B are formed on the leading ends of the heater receiving parts 147A. The coupling ribs 147B are bent from the leading ends of the heater receiving parts 147A at a predetermined angle and are inserted into the coupling slots 141C.

Referring again to FIG. 2, the heater supporter 150 supports a portion of the tube heater 130 spaced away from both ends portions of the tube heater 130 supported by the heater holder 140. In other words, the heater supporter 150 supports a portion of the tube 131 that is substantially disposed inside the reflector 120. In the current embodiment, the heater supporter 150 supports a middle portion of the tube heater 130 which is opposite to both end portions of the tube heater 130 with respect to the center of a circle formed by the tube heater 130. However, the portion of the tube heater 130 supported by the heater supporter 150, and the number of heater supporters 150 are not limited to those shown in FIG. 2. They may be varied according to the size and weight of the tube heater 130.

Referring to FIGS. 6 and 7, the heater supporter 150 includes a first supporter 151 and a second supporter 153. The first supporter 151 makes contact with the tube heater 130, and the second supporter 153 fixes the first supporter 151 to the reflector 120.

In more detail, the first supporter 151 has an approximate ring shape. A plurality of contact protrusions 151A are provided on the inner circumference of the first supporter 151. The contact protrusions 151A, which are provided on the inner circumference of the first supporter 151, make a predetermined angle with each other about the center of the first supporter 151. The contact protrusions 151A protrude from the inner circumference of the first supporter 151 toward the center of the first supporter 151. An imaginary circle formed by peaks of the contact protrusions 151A has a diameter equal to or relatively larger than the outer diameter of the tube 131. Therefore, when the tube heater 130, that is, the tube 131, is inserted into the first supporter 151, the contact protrusions 151A make tight contact with the outer circumference of the tube 131. A fixing groove 151B is formed in the outer circumference of the first supporter 151. The fixing groove 151B is formed by recessing a portion of the outer circumference of the first supporter 151 along the circumference of the first supporter 151. The fixing groove 151B is configured to receive a supporter fixing part 155 (described later).

The first supporter 151 is formed of a heat resistant material. Since the first supporter 151 makes contact with the tube heater 130, the first supporter 151 is formed of a heat resistant material for preventing the first supporter 151 from being damaged by heat generated from the tube heater 130. For example, the first supporter 151 may be formed of a heat resistant material such as a ceramic or a material containing at least a ceramic.

The second supporter 153 may be formed of a material having predetermined rigidity and elasticity such as a metallic material. Thus, the second supporter 153 can elastically support the tube heater 130. The second supporter 153 includes the supporter fixing part 155 and a reflector fixing part 157.

The supporter fixing part 155 is inserted in the fixing groove 151B. The width and thickness of the supporter fixing part 155 may be corresponding to those of the fixing groove 151B. The supporter fixing part 155 has a closed curve or opened curve shape depending on whether both ends of the supporter fixing part 155 make contact with each other or are spaced apart from each other. In other words, when both ends of the supporter fixing part 155 are in contact with each other, the supporter fixing part 155 has a ring shape, that is, a closed curve shape corresponding to the shape of the fixing groove 151B. When both ends of the supporter fixing part 155 are spaced apart from each other, the supporter fixing part 155 has an opened shape. Both ends of the supporter fixing part 155 may be spaced apart from each other or brought into contact with each other when the supporter fixing part 155 is inserted into the fixing groove 151B.

The reflector fixing part 157 extends from both ends of the supporter fixing part 155. As both ends of the supporter fixing part 155 are brought into contact with each other or spaced apart from each other, mutually facing surfaces of the reflector fixing part 157 are also brought into contact with each other or spaced apart from each other. The reflector fixing part 157 extends from both ends of the supporter fixing part 155 at an oblique angle with a tangential line substantially passing through both ends of the supporter fixing part 155. The angle between the reflector fixing part 157 and the tangential line substantially passing through both ends of the supporter fixing part 155 may be determined by a position of the tube heater 130 inside the reflector 120, that is, a distance between the tube heater 130 and the surface of the reflector 120, so as to reflect heat generated by the tube heater 130 more efficiently.

Reflector penetration holes 157A are formed through mutually facing leading end portions of the reflector fixing part 157. A fastener is inserted through the reflector penetration holes 157A so as to fix the heater supporter 150 (i.e., the second supporter 153) to the reflector 120. The reflector penetration holes 157A communicate with each other. Furthermore, one of the first fasteners L1 for fixing the heater base 110 and the reflector 120 may be additionally inserted through the reflector penetration holes 157A so as to fix the heater supporter 150 to the reflector 120.

Exemplary operations of the heater holder 140 and the electric hob 1 including the heater holder 140 will now be described according to the first embodiment.

When a user inputs an operation signal to the electric hob 1, the heater assembly 100 is operated according to the operation signal. In detail, power is input to the tube heater 130, that is, the filament 135, and then heat is generated from the filament 135 owing to the electric resistance of the filament 135. The heat generated from the tube heater 130 is transferred to a container placed on the container seat 7 of the top plate 5 so that food contained in the container can be heated and cooked. At this time, the reflector 120 reflects heat generated from the tube heater 130 so that heat can be transferred from the tube heater 130 to the container more efficiently.

The tube heater 130 is fixed to the heater base 110 and the reflector 120 via the heater holder 140 and the heater supporter 150. The heater holder 140 is formed of a metallic material having predetermined elasticity, and the second supporter 153 of the heater supporter 150 is also formed of a metallic material. Therefore, although a force is applied to the heater assembly 100, the heater holder 140 and the heater supporter 150 absorb the force as they are elastically deformed, so that the tube heater 130 (that is, the tube 131) can be minimally damaged.

When power is applied to the tube heater 130, that is, the filament 135, heat is generated from the tube heater 130 as explained above. At this time, the temperature of the tube heater 130 is varied according to whether the tube heater 130 is placed inside or outside the reflector 120. That is, the temperature distribution of the tube heater 130 is not uniform according to whether heat generated from the tube heater 130 is reflected by the reflector 120. For example, the temperature of both end portions of the tube heater 130 placed outside the reflector 120 may increase up to about 350° C., and the temperature of the other portion of the tube heater 130 placed inside the reflector 120 may increase up to about 1000° C. due to heat reflected by the reflector 120.

Therefore, in the current embodiment, the first supporter 151 of the heater supporter 150, which substantially makes contact with a portion of the tube heater 130 placed inside the reflector 120, is formed of a heat resistant material. Thus, although the temperature of the portion of the tube heater 130 placed inside the reflector 120 is increased to about 1000° C., smoking and burning of the heater supporter 150 can be minimized, and devitrification behavior of a portion of the tube 131 that makes contact with the heater supporter 150 can be minimized. In addition, since such smoking, burning, and devitrification can be minimized, the durability of the heater assembly 100 increases, and heat can be transferred from the tube heater 130 to a container more efficiently.

An electric hob will now be described with reference to the accompanying drawing according to a second embodiment.

Figure 8:
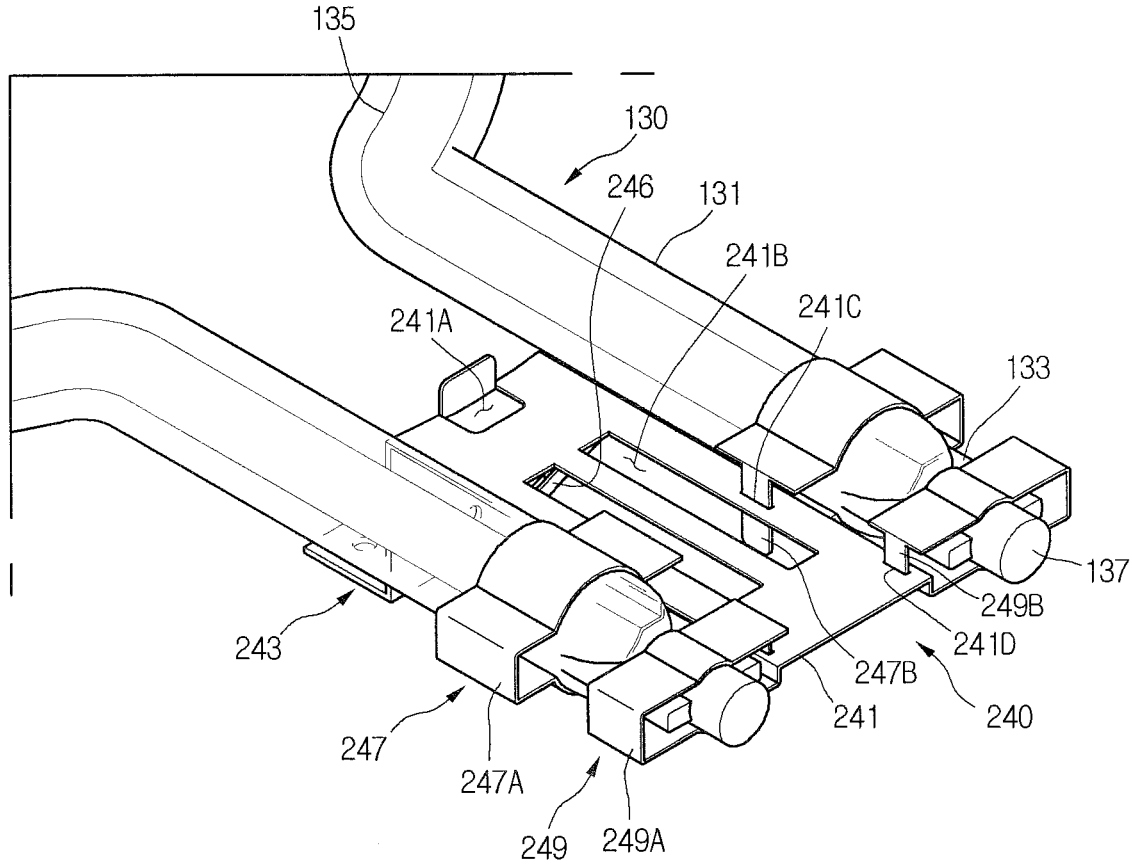
FIG. 8 is a perspective view illustrating a characteristic portion of an electric hob according to a second embodiment.

FIG. 8 is a perspective view illustrating a characteristic portion of an electric hob according to a second embodiment.

Referring to FIG. 8, in the current embodiment, a heater holder 240 is configured to support both end portions of a tube heater 130 (i.e., a tube 131) and pinch parts 133. For this, the heater holder 240 includes a holder body 241, a base fixing part 243, reinforcing ribs 246, and first and second heater supporting parts 247 and 249. Descriptions of the same elements as those of the first embodiment will be omitted.

In more detail, the holder body 241 includes first and second coupling slots 241C and 241D. First and second coupling ribs 247B and 249B (described later) are inserted into the first and second coupling slots 241C and 241D. The first and second coupling slots 241C and 241D are formed by cutting both side portions of the holder body 241 which have a predetermined length in the longitudinal direction of the holder body 241. The first and second coupling slots 241C and 241D are spaced apart from each other in the longitudinal direction of the holder body 241.

The first heater supporting parts 247 are configured to support both end portions of the tube 131. Each of the first heater supporting parts 247 includes a first heater receiving part 247A in which an end of the tube 131 is placed, and the first coupling rib 247B which is inserted in the first coupling slot 241C in a state where the end of the tube 131 is placed in the first heater receiving part 247A. Substantially, the first heater supporting parts 247 of the current embodiment have the same structure as the heater supporting parts 147 of the first embodiment.

The second heater supporting parts 249 are configured to support the pinch parts 133, and portions of insulating parts 137 disposed at both end portions of the tube heater 130. Each of the second heater supporting parts 249 includes a second heater receiving part 249A and a second coupling rib 249B. The pinch parts 133 and portions of the insulating parts 137 are placed in the second heater receiving parts 249A. For this, the second heater receiving part 249A are formed into a shape corresponding to the shape of the pinch parts 133. Alternatively, the second heater supporting parts 249 may be configured to support the pinch parts 133 or the insulating parts 137. The second coupling rib 249B is inserted through the second coupling slot 241D in a state where the pinch part 133 is placed in the second heater receiving part 249A.

In the current embodiment, the first and second heater supporting parts 247 and 249 are configured to support both end portions of the tube 131 and the pinch parts 133. Therefore, according to the current embodiment, the heater holder 240 can fix both end portions of the tube heater 130 more securely.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

In the above-described embodiments, the heater holder is fixed to the heater base, and the heater supporter is fixed to the reflector; however, the scope of the present disclosure is not limited thereto. That is, it may be sufficient that the heater holder and the heater supporter are fixed to any one of the heater supporter and the reflector so that the heater holder and the heater supporter can be used to fix the tube heater.

Furthermore, in the above-described embodiments, inert gas such as halogen gas may be filled in the tube to prevent oxidation of the filament while the filament generates heat.

Furthermore, the above-described embodiments may be applied to both the self-standing type electrode hob and the built-in type electric hob.

Moreover, in the above-described embodiment, the base fixing part is disposed on an inner surface of the heater base—that is, between the heater base and the reflector. However, the scope of the present disclosure is not limited thereto. For example, alternatively, the base fixing part may be fixed to an outer surface of the heater base.

What is claimed is:

1. An electric hob, comprising:

a heater base having a cylindrical shape with an open top, the heater base comprising a first rim formed with a first heater hole and a first bottom surface, the heater base further comprising a hole provided in at least one of the first rim or the first bottom surface and located under the first heater hole;

a tube heater disposed within the heater base, the tube heater comprising a tube and a filament disposed inside the tube, both ends the tube heater being inserted into the first heater hole;

a reflector installed at an inner side of the heater base and configured to reflect heat generated from the tube heater, the reflector having a cylindrical shape such that an outer surface of the reflector faces an inner surface of the heater base and comprising a second rim formed with a second heater hole into which the both ends of the tube heater is inserted and a second bottom surface;

a heater holder adapted to fix the tube to the heater base or the reflector, wherein the heater holder is configured to support the tube heater elastically, wherein the heater holder comprises:

a holder body;

a plurality of heater supporting parts disposed at both sides of the holder body to be coupled to the both ends of the tube heater;

a fixing part configured to allow the holder body to be fixed at one side of the heater base, wherein the fixing part includes a first portion that extends from the holder body and a second portion bent from the first portion, at least one of the first or second portion having a coupling hole coupled to the hole by a member, wherein the first portion and the second portion are disposed between the outer surface of the reflector and the inner surface of the heater base, wherein the first portion is interposed between an inner surface of the first rim of the heater base and an outer surface of the second rim of the reflector, and wherein the second portion is interposed between an inner surface of the first bottom surface of the heater base and an outer surface of the second bottom surface of the reflector;

a casing having an open top and configured to receive the heater base, the tube heater, the reflector, and the heater holder; and a top plate configured to cover the open top of the casing and on which food or a container containing food is placed to be heated by heat generated by the tube heater.

2. The electric hob according to claim 1, wherein the fixing part is formed by bending a portion of the holder body a predetermined angle.

3. The electric hob according to claim 1, wherein at least one of the plurality of heater supporting parts comprises:

a heater receiving part on which at least one of both end portions of the tube heater or pinch parts provided at the end portions of the tube heater are placed; and a coupling rib configured to be coupled to a coupling slot of the holder body in a state in which at least one of the end portions of the tube heater or the pinch parts are placed on the heater receiving part.

4. The electric hob according to claim 1, wherein the holder body is elastically deformable with respect to the fixing part fixed to one of the heater base and the reflector, and wherein at least one of the plurality of heater supporting parts is elastically deformable with respect to the holder body.

5. The electric hob according to claim 4, wherein the holder body comprises at least one coupling slot through which a coupling rib of the at least one of the plurality of heater supporting parts is inserted.

6. The electric hob according to claim 1, further comprising at least one heater supporter that elastically supports a portion of the tube heater disposed inside the reflector.

7. The electric hob according to claim 6, wherein the at least one heater supporter includes a first supporter that contacts the tube of the tube heater and a second supporter that fixes the first supporter to one of the heater base or the reflector.

8. The electric hob according to claim 7, wherein the first supporter has a ring shape.

9. The electric hob according to claim 8, wherein the first supporter includes a plurality of contact protrusions that protrudes from an inner circumference of the first supporter and a fixing groove formed in an outer circumference of the first supporter.

10. The electric hob according to claim 9, wherein the plurality of contact protrusions makes a tight contact with the tube of the tube heater when the tube of the tube heater is inserted through the first supporter.

11. The electric hob according to claim 10, wherein the first supporter is made of a heat resistant material.

12. The electric hob according to claim 9, wherein the second supporter includes a supporter fixing part inserted in the fixing groove of the first supporter and a reflector fixing part fixed to one of the heater base or the reflector.

13. The electric hob according to claim 12, wherein the reflector fixing part is fixed to one of the heater base or the reflector by a plurality of fasteners.

14. The electric hob according to claim 12, wherein when both ends of the supporter fixing part make contact with each other, the supporter fixing part has a closed curve shape, and wherein the reflector fixing part extends from the both ends of the supporter fixing part.

15. The electric hob according to claim 14, wherein the second supporter is made of a material having a predetermined rigidity and elasticity such as a metallic material.

* * * * *